United States Patent [19]

Linderfelt

[11] Patent Number: 4,579,437

[45] Date of Patent: Apr. 1, 1986

[54] APPARATUS FOR PROCESSING PHOTOGRAPHIC FILMS INCLUDING DENTAL X-RAY FILMS

[76] Inventor: Hal R. Linderfelt, 5540 A Avenida Soseiga, Laguna Hills, Calif. 92653

[21] Appl. No.: 644,231

[22] Filed: Aug. 27, 1984

[51] Int. Cl.[4] ..... G03D 3/04; G03D 3/10

[52] U.S. Cl. ..... 354/322; 354/328

[58] Field of Search ..... 354/316, 319, 320, 321, 354/322, 328

[56] References Cited

U.S. PATENT DOCUMENTS 2,527,959 10/1950 Quinn ..... 354/322

FOREIGN PATENT DOCUMENTS 0699480 11/1979 U.S.S.R. ..... 354/320

OTHER PUBLICATIONS

"Drum Type Developing Machine for Photochemical Processing and Drying of Photographic Materials", Journal of Applied Spectroscopy, vol. 18, No. 1, pp. 129–131, Bezuglyi, V. I.

*Primary Examiner*—A. A. Mathews

*Attorney, Agent, or Firm*—K. H. Boswell

[57] ABSTRACT

An apparatus for processing radiation sensitive film, particularly dental x-ray film, has a housing with tanks located thereon capable of holding developer, fixer and wash. An arcuate shaped track is located on the housing in association with the tanks. A gear serving as a track follower moves across the track. A film holder is operatively attached to the gear at a point off center from the center of rotation of the gear. As the gear moves across the track, the film holder is moved in a pathway whereby it is immersed in the developer, in the wash and in the fixer tanks.

21 Claims, 5 Drawing Figures

10
12
14
32
34
36
42
44
46
48
50
56
58
60
62
66
68
70
72
74
76
78
80
82
84
86
88
90
92
94
96
98
100
102
110
112
114
116
118

10
16
18
30
28
36
56
FIX
114
110
34
38
108
58
3
3
136
MOTOR
138
140
118
WASH
142
144
50
MOTOR
14
82
90
98
86
78
72
94
92
68
60
62
64
38
76
88
40
DEVELOPER
32
26

APPARATUS FOR PROCESSING PHOTOGRAPHIC FILMS INCLUDING DENTAL X-RAY FILMS

BACKGROUND OF THE INVENTION

This application is directed to an apparatus for automatic processing of radiation sensitive film. More particularly, the invention is directed to an apparatus for the developing of dental x-ray film.

A variety of self contained apparatus for developing a dental x-ray film are known. These apparatus generally fall into two categories. In the first category are apparatus wherein films are held fixed in a container. The different processing fluids, i.e., the developer, fixer and rinse, are each held in a storage container and are pumped in a sequence one at a time into the container wherein the film is located and then drained from that container. The second category of apparatus utilize separate compartments for the different developing fluids, with the film passing from one compartment to the next.

In the first category of apparatus described above, problems have resulted because of contamination of one of the developing fluids by a further of the fluids because of inherent problems in incomplete removal of each fluid from the tank wherein the film is located. Further, mechanical pumps and the like, besides being expensive, are generally susceptible to wear and tear and as such must be maintained on a very regimented basis in order to keep these systems working.

The second category of apparatus overcome the disadvantages of the first in that the developing fluids are maintained in their own separate containers at all times, and pumps and the like are not needed. In this category of apparatus, one type of structure or another has to be utilized to move the film in sequence through the appropriate developing fluids. In one solution to this problem, a track defined by a plurality of rollers is utilized to pass the films through the sequences of developing fluids. While this type of device certainly has its utility, because the individual dental x-ray films are of small size, and are not on a continuous roll such as camera film would be, at times the individual films can get jammed within the pathway of the apparatus. Since the time the film spends in the individual fluid is critical, especially for the developer, the jamming of the film in the pathway can lead to overdeveloping or the like and thus the loss of the images on the film.

A second type of apparatus which can be generally classified as a transport system utilizes an endless chain belt or the like, or a sliding carriage to move the individual films from one tank of developing fluid to the next. For the most part these systems require the attachment of individual films to individual clips, and the films are essentially developed one at a time. Because of this, in order to process a number of films, the devices essentially require constant operator attention for loading and unloading of the individual films in order to pass them through the device one at a time. Also, since the endless belt, carriage rod or the like must be linear, four tanks are generally used, first a developer tank, then a first rinse, then a fix tank, then a second rinse. The linearity of the endless belt or carriage precludes the use of a single rinse tank for both rinsing operations.

BRIEF DESCRIPTION OF THE INVENTION

In view of the above, it is considered that there exists a need for a new and better apparatus for the development of radiation sensitive film, especially dental x-ray film. It is therefore a broad object of this invention to fulfill this need. it is a further object of this invention to provide an apparatus for the development of dental x-rays or the like which includes the versatility of developing at one time either a single piece of film or simultaneously a number of pieces of film simultaneously. Further, it is an object of this invention to provide an apparatus for developing of dental x-ray films and the like which can move the dental x-ray film between the individual developing fluid utilized, and additionally, when the film is immersed in a particular developing fluid, the apparatus is capable of agitating the fluid so as to prolong the life of the fluid and insure consistent developing results. Further it is an object of this invention to provide an apparatus which can be easily and conveniently utilized by unskilled personnel.

These and other objects, as will become evident from the remainder of this specification, are achieved in an apparatus for processing radiation sensitive film which comprises: a housing; a plurality of fluid containing tanks located on said housing in association with one another; an arcuate shaped track means located on said housing in operative association with said tanks; a track follower means located in operative association with said track means so as to move in a pathway on said track means; a film carrier means for carrying film, said film carrier means operative associated with said track follower means so as to be moved by said track follower means successively from one of said tanks to another of said tanks; means for moving said track follower means in said pathway on said track means.

Further, these objects are achieved in an apparatus for processing radiation sensitive film which comprises: a housing; a plurality of fluid containing tanks located on said housing in association with one another; a first motor located on said housing; a gear rack located on said housing in association with said tanks; a gear located on said gear rack; a film carrier operative connected to said gear so as to be moved by said gear; a connecting means operatively associated between said first motor and said gear whereby said gear is moved on said gear rack in response to motion imparted to said connecting means by said motor and in response thereto said gear moving said film carrier from one of said tanks to a further of said tanks.

In the illustrative embodiment of the invention, the gear rack is formed as a gear sector with the track follower means comprising a gear which moves across the gear sector. In the illustrative embodiment, the film carrier means is connected to the gear in a position so as to be off-center with respect to the center of rotation of the gear. Because of this, the portion of the film carrier means which carries the film can move in an epitrochoidal manner from one of the tanks to another of the tanks. Additionally, this allows the use of a central rinse tank, yet still provides for rinsing of the film after exposure of the film to both the developer and to the fixing fluid.

BRIEF DESCRIPTION OF THE DRAWINGS

This invention will be better understood when taken in conjunction with the drawings wherein.

Figure 1:
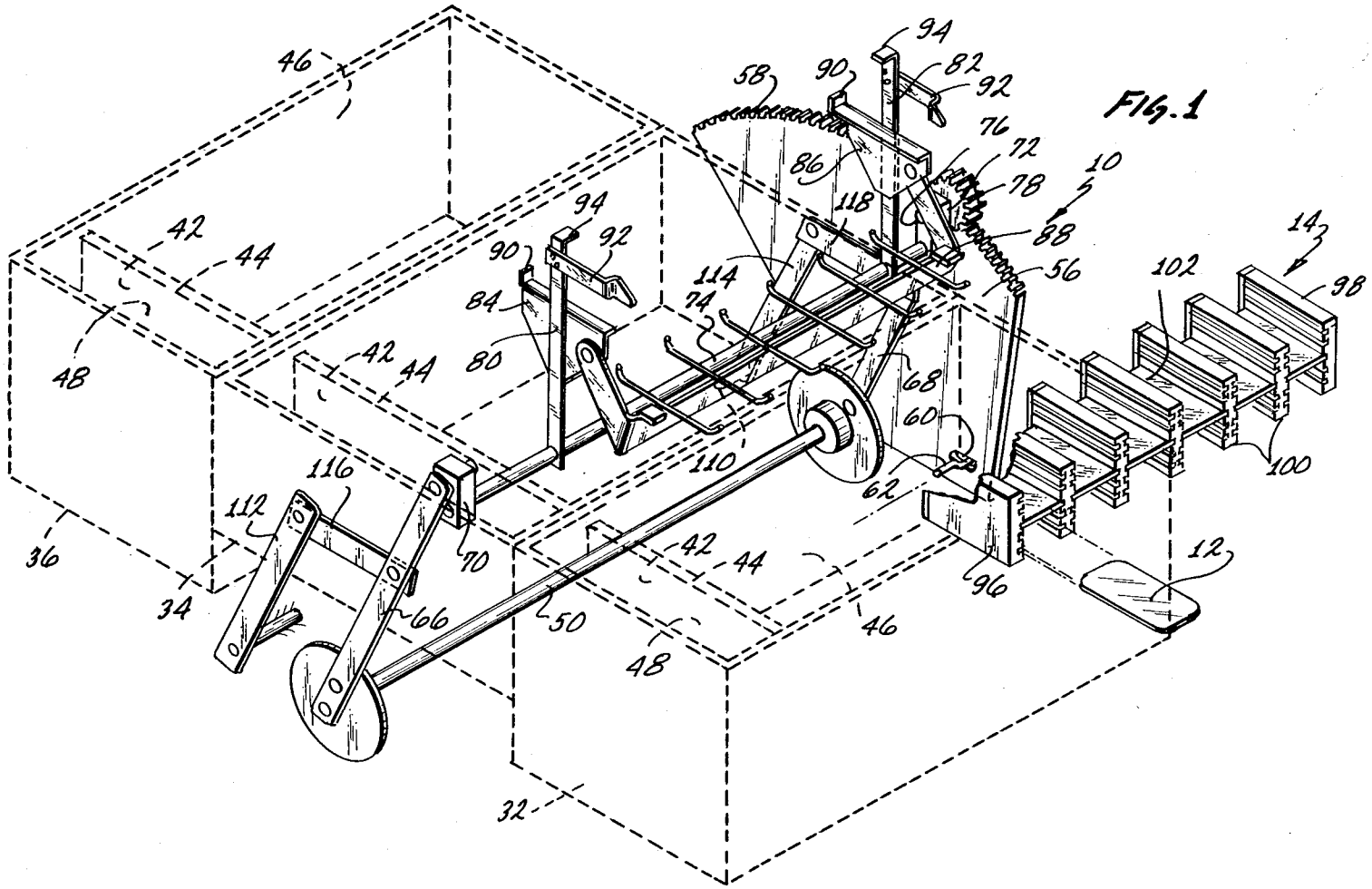
FIG. 1 is a rear isometric view showing certain components of the invention in solid lines and other components in phantom line, with a portion of the Fig. broken away for clarity of underlying components.

The invention described in this specification and shown in the drawings utilizes certain principles and/or concepts as are set forth in the claims appended to this specification. Those skilled in the machine arts will realize that these principles and/or concepts are capable of being utilized in a variety of embodiments which may differ from the exact embodiment utilized for illustrative purposes herein. For this reason, this invention is not to be construed as being limited solely to the illustrative embodiment, but should only be construed in view of the claims.

DETAILED DESCRIPTION OF THE INVENTION

In the drawings there is shown a device 10 which while primarily intended to be utilized in developing dental x-ray films, could be utilized in developing of other photo or radiation sensitive films. In any event, for illustrative purposes herein, the device 10 will be discussed in conjunction with the processing of dental x-rays.

Normally, these dental x-rays exist as single pieces of dental x-ray film, such as the film 12 shown in FIG. 1. After appropriate exposure of the film and removal from its protective packet, one or more pieces of film are inserted into a film holder 14. As is obvious from viewing FIG. 1, the film holder 14 is capable of holding a number of the pieces of film 12. This allows for concurrent development of a plurality of individual pieces of film or a single film if desired.

The device 10 has a bottom housing 16 and a top housing 18 which is hinged to the bottom housing 16. These fit together around a perimeter utilizing a gasket 20 so as to seal the interior of the device 10 from ambient light.

Figure 2:
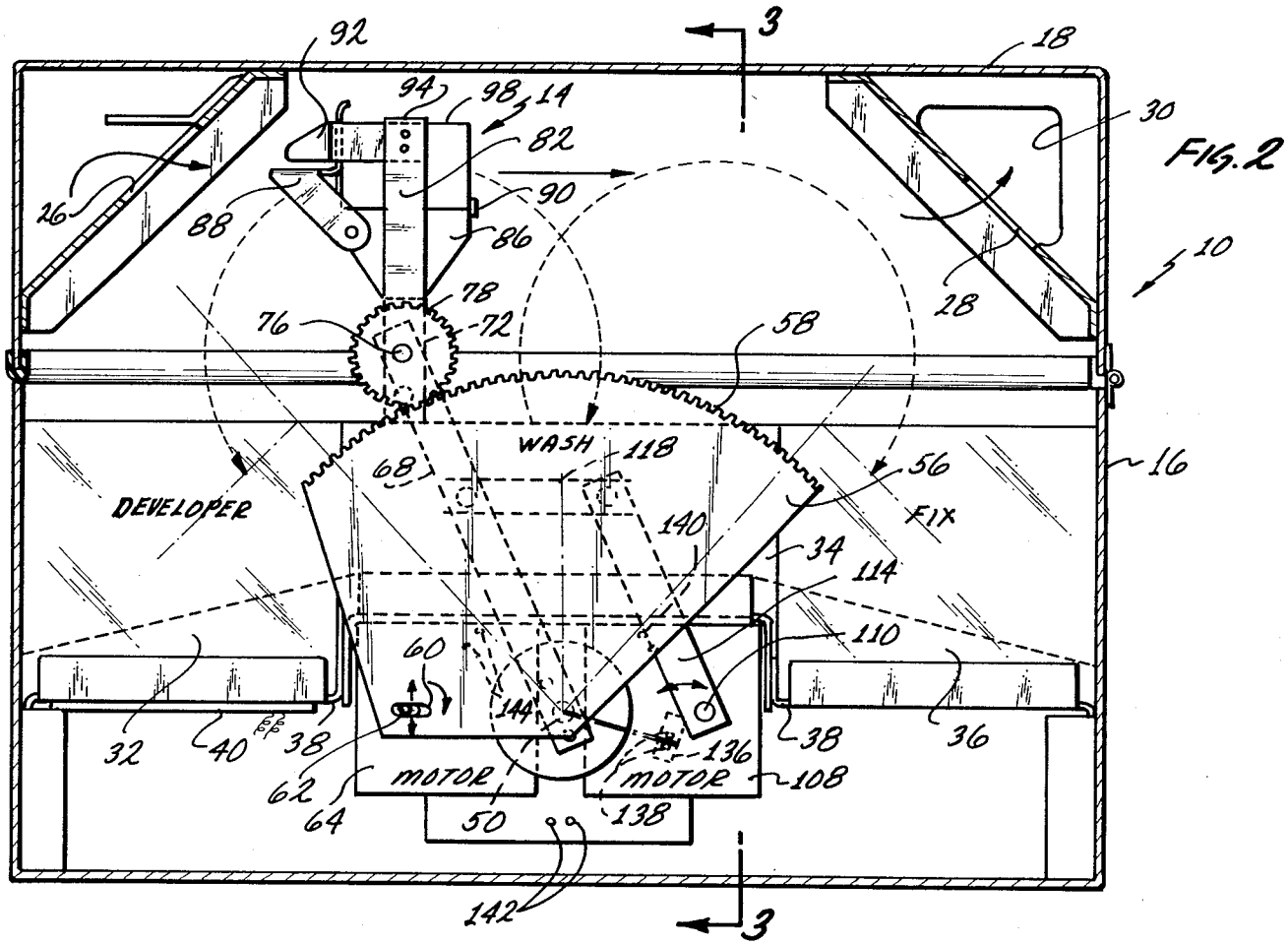
FIG. 2 is a front elevational view in partial section of the components seen in FIG. 1 as well as the position of these components and other additional housing components.
Figure 3:
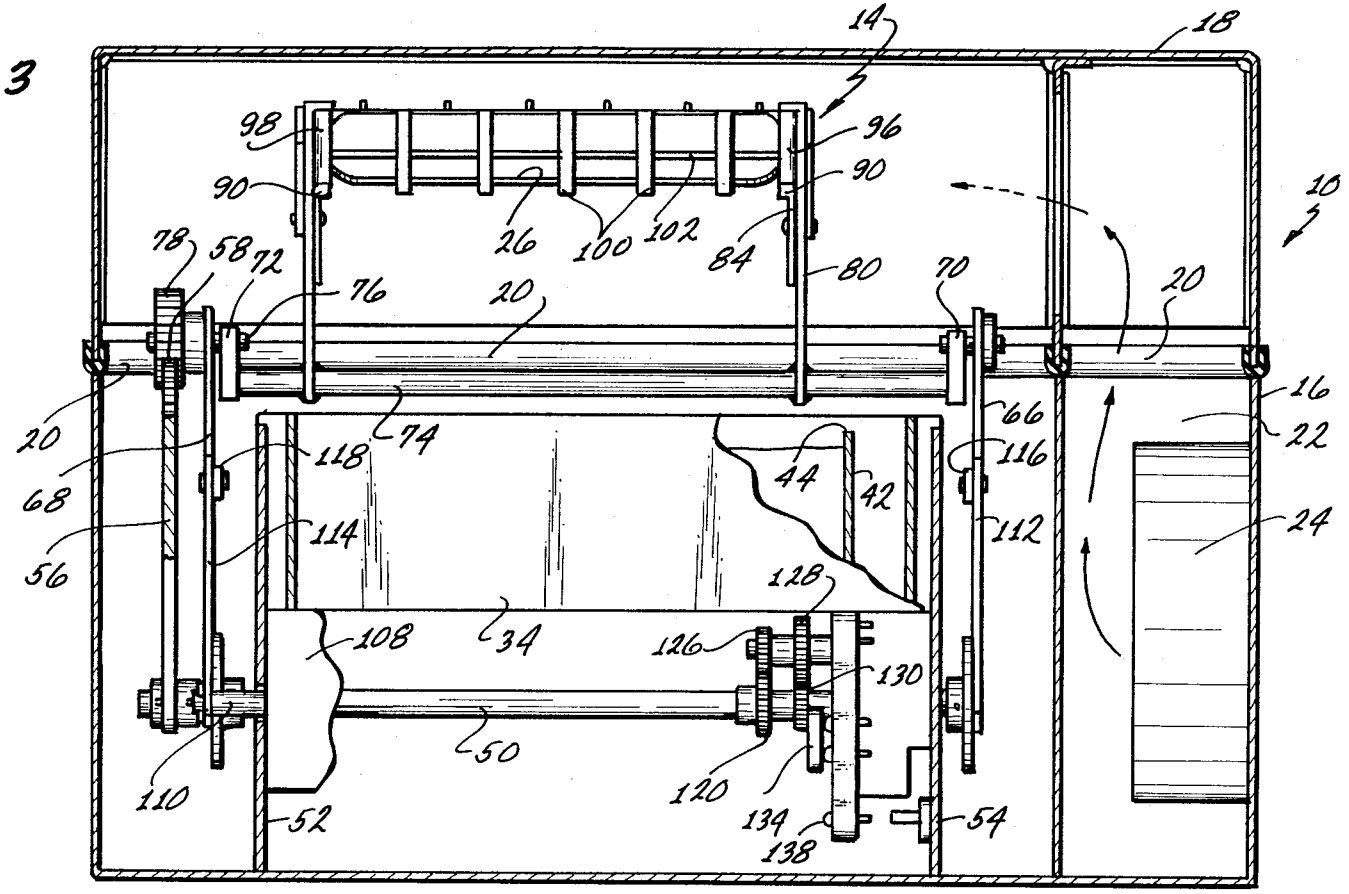
FIG. 3 is an end elevational view in section about the lines 3—3 of FIG. 2.
Figure 4:
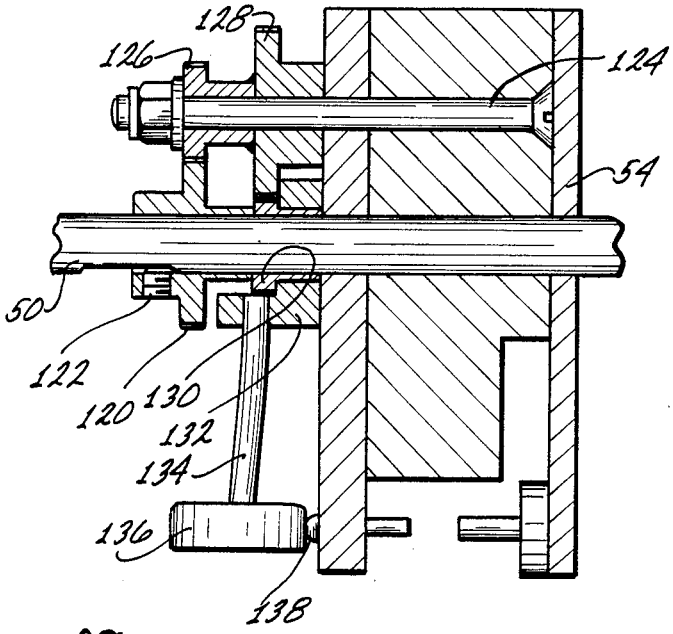
FIG. 4 is a fragmentary side elevational view in section of a control mechanism generally located in the bottom central portion of FIG. 2.

As is evident from viewing FIG. 3, an air plenum chamber 22 is formed on the back side of both the bottom and top housings 16 and 18. A fan 24 is located in the wall of the bottom housing 16 within the chamber 22. The fan draws air from the ambient into the interior or the chamber 22. In viewing FIG. 2, it can be seen that air from the chamber 22 is then fed via opening 26 into the interior of the device 10 for drying of the film after appropriate development. Air from the opening 26 traverses across the top of the interior of the device 10 and exits out of an exit opening 28 on the opposite side of the top housing 16. Air is then exhausted to the ambient through opening 30 formed in the back side of the top housing 18.

Three fluid tanks, tanks 32, 34 and 36, are located within the interior of the device 10. Tank 32 is utilized to hold developing fluid, tank 34 is utilized to hold a water rinse, and tank 36 is utilized to hold a fixing fluid. Each of the tanks 32, 34 and 36 are easily removed from the interior of the device 10 for filling, draining, washing and the like, since each of these are individual tanks which simply rest upon an appropriate support member 38 formed within the bottom housing 16. A heating unit 40 is positioned below the developer tank 32 to heat the developing fluid located within the developing tank 32, as is required for specific developing processes utilized within the device 10. The heating pad 40 would be a typical resistant type heating pad and would include an appropriate temperature sensing element built therein so as to allow for precise control of the exact temperature of the developing fluid within the developing tank 32. Preferredly, the developing tank 32, as well as the remainder of the tanks, 34 and 36, would be formed of stainless steel.

Each of the tanks 32, 34 and 36 include a baffle collectively identified by the numeral 42 located at one end of the tank. The top 44 of the baffle 42 is slightly depressed with respect to the top of the appropriate tank, as for instance, tank 32. This divides the tanks, such as tank 32, into a large chamber 46 and an overflow chamber 48. The chamber 46 would be filled with the appropriate fluid such as developing fluid up to approximately the edge of the top 44 of the baffle 42. The overflow chamber 48 would serve as a reservoir to receive any excess fluid should too much fluid be poured into the container, such as container 32, as well as any "slop" which might occur in bumping or jiggling the device 10. This would prevent any fluid from being expelled over the edge of the appropriate tank, such as tank 32 and onto interior surfaces of the device 10. This, of course, facilitates clean-up and maintenance of the device 10 and longevity of its parts protecting them from the caustic nature of certain developing and fixing fluids.

A shaft 50 is appropriately journaled in end plates 52 and 54 allowing rotation of the shaft 50. Mounted on one end of the shaft 50 but rotatable thereon is a gear sector 56. The gear sector 56 includes a gear rack 58 which is arcuate in shape. The gear sector 56 is essentially a quadrant with the gear rack 58 extending over approximately one quarter of the circumference of a circle. The gear sector 56 includes a small slot 60 located essentially in a horizontal line with the shaft 50. A small crank 62 has its crank arm engaged in the slot 60. The other end of the crank 62 is attached to an agitation motor 64. When the motor 64 is activated as hereinafter explained, it rotates the crank 62 which in turn moves within the slot 60. This causes the gear sector 56 to oscillate back and forth about its center of rotation on shaft 50. Because the size of the crank shaft 62 is quite small with respect to the radius of the arcuate gear rack 58, the movement of the gear rack 58 is such that it moves only a few degrees first in one direction and then a few degrees in the opposite direction.

Also attaching to shaft 50 on one end thereof is a connecting member 66 and on the other end a similar connecting member 68. These are fixed to the shaft 50 such that they move in unison with respect to one another with movement of one transferred to the other via rotation of shaft 50. Pivotably connected to the upper ends of the connecting members 66 and 68 are small links 70 and 72 respectively. The links 70 and 72 are connected by a further shaft 74. The links are free to rotate with respect to the connecting members 66 and 68 but are fixed to the shaft 74.

The link 72 is fixed to one end of a short axle 76 and a gear 78 is fixedly attached to the other of its ends with the upper end of connecting means 72 pivotably connected inbetween. The gear 78 serves as a track follower or circular track member, in that it engages with the gear rack 58 on the gear sector 56. The axle 76 is placed at the center of rotation of the gear 78. However, because the link 72 connects between the shaft 74 and the axle 76, the shaft 74 is off center with respect to the center of rotation of the gear 78. Since the shaft 74 is fixed to the link 72 which in turn is fixed to the gear 78 via the axle 176, the axial axis of the shaft 74 rotates around the gear 78 as the gear 78 rotates.

First and second arms 80 and 82 are fixed to the shaft 74 and are aligned with one another. Brackets 84 and 86 are respectively attached to the arms 80 and 82. A retaining member 88 is pivoted to the brackets 84 and 86. Together these parts comprise a film carrier 90 to which the film holder 14 is reversibly connected.

Each of the brackets 84 and 86 include a small tab, collectively identified by the numeral 90, which serves as a limit tab, and further they include spring arms, collectively identified by the numeral 92, which project in the direction away from the limit tab 90. The top of the arms 80 and 82 are bent over toward one another forming top tabs collectively identified by the numeral 94. The film holder 14 slides onto the brackets 84 and 86 underneath the top tabs 94 by sliding end pieces 96 and 98 of the film holder along the brackets 84 and 86. The film holder 14 is slid over the brackets 84 and 86 until the back edge of the end pieces 96 and 98 abutt against the tabs 91.

As is evident from FIG. 1, the end pieces 96 and 98 of the film holder 14 are joined by a series of internal film holding plates, collectively identified by the numeral 100, which are linked together with connecting plates 102. As is evident, a variety of different sizes of film 12 could be held within the film holder 14 by utilizing different sized film holding plates 100 and connecting plates 102. In any event, once a piece of film or multiple pieces of film 12 are loaded in the film holder 14 and the film holder 14 is inserted into the film carrier 90, the retaining member 88 is pushed upwardly to lock with the spring members 92. This locks the film 14 into the film carrier 90. Also, each of the film holding plates 10 includes an end plate 104 located thereon which prevents the film 12 from sliding all the way through the two adjacent film holding plates 100. The retaining member 88 further includes a series of retaining fingers 106 fixedly located thereon which fit across the connecting plates 102 between two adjacent film holding plates 100 so as to retain the individual films 12 in position in the film holder 14. When the retaining member 88 is clipped behind the spring arms 92, the retaining fingers 106 in combination with the end plates 104 fixedly hold the individual pieces of film 12 in the film holder 14.

Since the arms 80 and 82 are fixed to the shaft 74, any movement of the shaft 74 of course is propagated to them and to the film carrier 90 and the film holder 14 located therein. If the connecting members 66 and 68 are caused to pivot with respect to movement of the shaft 50, this movement of course is communicated to the gear 78. Since the gear 78 is engaged with the gear sector 56, movement of the connecting arms 66 and 68 rotate the gear 78 which moves it across the gear rack 58. This rotation is transmitted via axle 76 to the link 72 and to the shaft 74. This in turn causes the shaft 74 and the film carrier 90, attached thereto, to be both rotated and to move in a circular pathway. However, since the shaft 74 is off center with respect to the center of rotation of the gear 78, the movement of the film carrier 90 is a complex movement. The film carrier 90 moves in an epitrochoidal pathway in response to rotation of the gear 78 on the gear sector 56.

To cause rotation of the gear 72 the connecting members 66 and 68 are moved as follows. A motion motor 108 drives a shaft 110. Fixedly connected to the ends of the shaft 110 so as to move in response to rotation of shaft 110 are connecting links 112 and 114. Further connecting links 116 and 118 then connect the links 112 and 114 the connecting members 66 and 68 respectively. Links 116 and 118 are pivotally connected to the links 112 and 114 and also to the connecting members 66 and 68 respectively utilizing small rivets or the like.

In essence, the connecting links 112, 116 and the connecting member 66 and the connecting links 114, 118 and the connecting member 68 form sets of parallel linkages. Since the motor shaft 110 and the shaft 50 are fixed within the end plates 52 and 54, the fourth missing parallel link of each set is supplied by the end plates 52 and 54. In any event, rotation of the motion motor 108 is communicated via the motor shaft 110 to the connecting member 68 causing rotation of the shaft 50 and movement of the gear 78.

Operation of the device 10 can now be explained. In FIGS. 2 and 3 the film carrier 90 is shown in what is described as the "load and dry" position. The gear 78 is located about midway between the center of the gear rack 58 in its left hand edge. This positions the connecting arms 80 and 82 straight up such that the film holder 14 can be easily loaded. This position is also shown in solid line in FIG. 5 for the fragmentary portion of the connecting arm 82 shown.

When the device is energized, the motion motor 108, which is a very slowly rotating motor, drives the shaft 110 to move the connecting links 112 and 114 and thus the connecting members 66 and 68. This movement is to the left in FIGS. 2 and 5. This causes rotation of the gear 78 along the gear rack 58. This, in turn, is transmitted via the off center shaft 74 to the film carrier 90 such that the top of the film carrier moves to the left along the dotted epitrochoidal pathway to position the film holder 14 within the developer tank 32 which is located on the left. At this time, as hereinafter explained, the motion motor 108 is turned off, and the agitator motor 64 is turned on. Since the motion motor 108 is off, connecting members 66 and 68 are held fixed. However, with the starting of the agitation motor 64, the gear sector 56 is rotated first in one direction and then in the other direction around its center of rotation about shaft 50. This motion is communicated to the gear 78 which transfers the motion via axle 76 and link 72 to the shaft 74. The backward and forward movement of the gear sector 56 causes first clockwise and then counterclockwise rotation of the gear 78 and corresponding clockwise and counterclockwise agitation of the film carrier 90 within the developing tank 32.

The backward and forward movement of the film carrier within the developer tank accomplishes several things. It agitates the film within the developer fluid which stirs the developer fluid to ensure (1) that it is of constant temperature, and (2) that is is continuously agitated to mix it. Further it removes any air bubbles which may adhere to the surface of the film to ensure a constant and consistent developing of the film.

After a sufficient residual time of the film in the developer tank 32 as governed by a timer as hereinafter explained, the agitator motor 64 is turned off and the motion motor 108 is turned on; however, its direction is reversed. Reversal of the direction will also be explained below. In any event, reversal of the direction of the motion motor 108 rotates the gear 78 clockwise as seen in FIG. 2, moving the film carrier such that it retraces its path from the developing position past the load position and comes to rest in a position as seen in the center phantom representation of the film carrier in FIG. 5. This positions the film holder 14 within the wash tank 34. At this time, once again the motion motor 108 is inactivated and the agitator motor 64 is activated. This insures rinsing of the film located within the film holder 14.

Again after a preprogrammed time, the agitator motor 64 is inactivated and the motion motor 108 is reactivated. The activation of the motion motor 108 at this time maintains its direction of rotation such that the gear 78 continues it clockwise rotation across the top of the gear sector 56. This results in lifting of the film carrier 90 up out of the wash solution clockwise along its epitrochoidal pathway and when the gear 78 is positioned on the right hand side of the gear rack 58, the film carrier has been rotated clockwise into the fix tank 36. Again the motion motor 108 is inactivated and the agitator motor 64 is activated. The film holder 14 is then agitated within the fixing solution within the fix tank 36 with the agitation accomplishing the same goals as were accomplished in the development tank, except of course it is not necessary to agitate the fixer solution with regard to a temperature gradient in that it is at room temperature. In any event, after an appropriate time period for fixing of the films 12, once again the agitator motor 64 is inactivated and the motion motor 108 is activated.

However, upon reactivation of the motion motor 108, its direction of rotation is once again reversed, such that it is now rotating in the same direction of rotation that it did when it was first activated from the load position. This then moves the film carrier such that it rotates counterclockwise as seen in FIG. 2 up and over and repositions it in the wash tank 34. Once in the wash tank 34, motion of the motion motor 108 ceases and the activation motor 64 is again activated. After a sufficient rinse in the wash tank 34, the activation motor 108 is deactivated and the motion motor 108 is reactivated in the same direction of rotation such that the gear 78 is still rotating counterclockwise toward the left side of the gear sector until it is once again located in the load position as seen in FIG. 2.

Once again the motion motor 108 is inactivated and the fan 24 is activated. Concurrently, the agitator motor 64 is also activated such that in the load and dry position the film carrier is agitated in the air stream which is blowing between the openings 26 and 28 in the top housing 18. This assists in drying the films 12 within the moving air stream. After a sufficient drying period has expired, the agitator motor 64 is deactivated as well as is the fan 24 and the development cycle is complete. The top housing 18 can now be lifted and the dry, developed films 12 removed from the apparatus 10.

Control of the operation is as follows. A gear 120 is fixed via set screw 122 to the shaft 50. A small axle 124 is positioned directly above the shaft 50 and carries a gear 126 which is fixed to a second gear 128 thereon. The gears 126 and 128 are free to rotate about the axle 124. The gear 126 meshes with the gear 120 and as such rotation of the shaft 50 is communicated via the gear 120 to the gears 126 and 128 to rotate both of them. A gear 130 is suspended on shaft 50 but is free to rotate independent of shaft 50. The gear 130 meshes with the gear 128. The gear train 122, 126, 128 and 130 are utilized to amplify the rotation of the shaft 50.

A small housing 132 is attached to the gear 130 and rotates in unison with the gear 130. A nylon rod 134 is threaded into the housing 132 so as to move in unison with the housing 132. The rod 134 contains a electrical conductive wheel 136 on its end which travels in an arcuate pathway in response to rotation of the shaft 50. Four, two pair sets of contacts, contacts sets 138, 140, 142 and 144, are positioned in an arcuate manner in the pathway of the wheel 136. Since the wheel 136 is made of an electrically conductive material, when it rides over and contacts both of the pairs of any one of the sets of contacts, such as contact set 138, it forms an electrical bridge between the two identical contacts of the set to complete a circuit. The contact set 138 is positioned in what can be described as the "load" position in FIG. 5. The contact set 140 is positioned in the "develop" position with the contact set 142 in the "rinse" position and the contact set 144 in the "fix" position.

Figure 5:
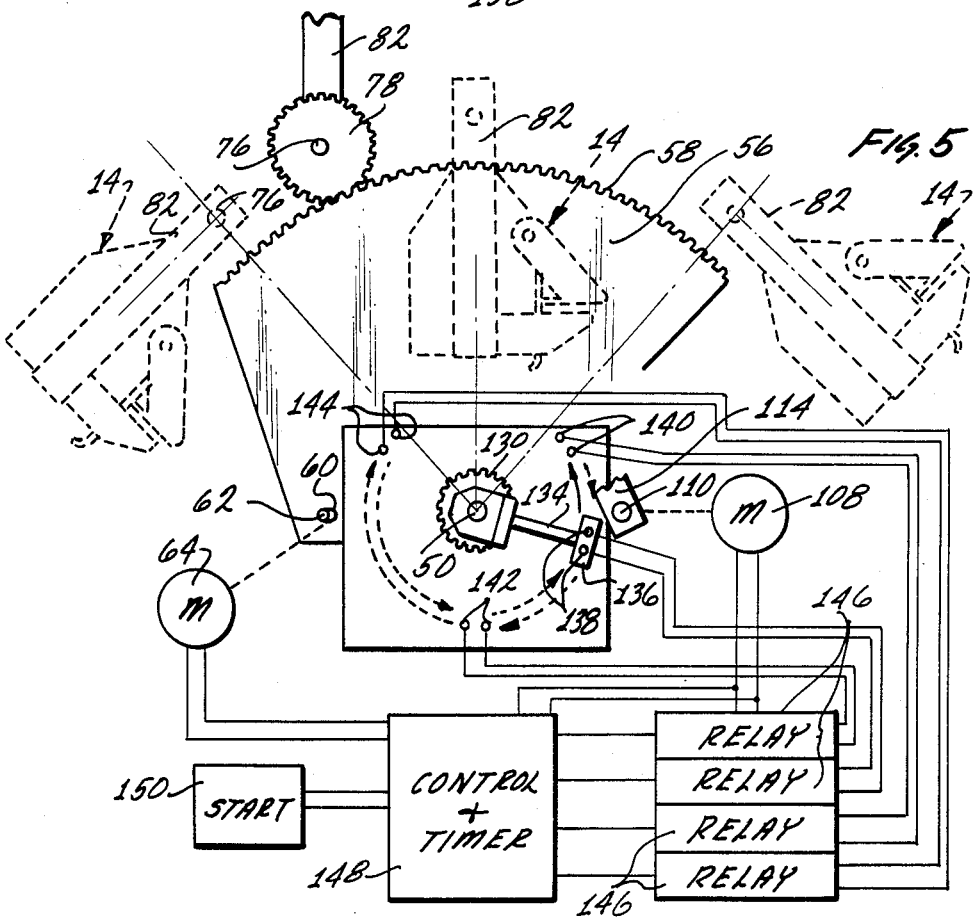
FIG. 5 is a schematic view of certain of the components of the invention which are generally located in the central portion of FIG. 2 and including certain of the components seen in FIG. 4.

The contact sets 138, 140, 142 and 144 are connected to appropriate relays, collectively identified by the numeral 146 in FIG. 5. The relays, in turn, are connected to a timer and control mechanism 148 which is activated by a start button 150 with the appropriate motors 64 and 108 also electrically connected to the control mechanism 148.

When the film carrier is in the "load" position, the wheel 136 is positioned to make electrical contact between the "load" contact set 138. At the start of the sequence, this is relayed via the relays 146 to the control and timer 148 which causes activation of the motion motor 108 in a first direction of rotation. When the wheel 136 has been rotated such that it then makes electrical contact with the "develop" contact set 140, the relays 146 are reset to first stop the motion of the motor 108 and set it such that when it is again reactivated, its direction will be reversed, and to activate the motor 64.

After an appropriate time period as governed by the control and timer 148, the motor 64 is then inactivated and the motor 108 reactivated. The motor 108 is now turning in its opposite direction which results in the rotation of the shaft 50 in the opposite direction and movement of the wheel 136 back across the "load" contact set 138. However, contacts with these contacts the second time under the control of the control and timer mechanism 148 maintains the current direction of rotation of the motor 108 and maintains activation of the motor 108 until the wheel 136 has contacted the "rinse" contact set 142.

At this time the motor 108 is inactivated; however it is still set to rotate in the same direction of rotation and the motor 64 is activated. After appropriate agitation of the film carrier in the rinse solution, the motor 64 is inactivated and the motor 108 is reactivated to then further cause rotation of the shaft 50 until the wheel 136 contacts the "fix" contact set 144. Upon this contact, the relays 146 stop the motor 108 and set is such that, upon reactivation, its direction will once again be reversed back to the original direction. The agitation motor 64 is turned on for a period of time governed by the control and timer mechanism 148 and after this time has expired the motor 64 is inactivated and the motor 108 is activated such that the wheel 136 in FIG. 5 is moved counterclockwise back toward the "rinse" contact set 142.

When the wheel 136 once again contacts the "rinse" contacts 142, the motor 108 is halted, but its direction of rotation is not changed, and the motor 64 is activated to agitate the film holder within the wash tank 34. After an appropriate time period as controlled by the control and timer mechanism 148, the motor 64 is deactivated and the motor 108 is reactivated, causing movement of the wheel 136 from the "rinse" contact set 142 back to the "load" contact set 138. When contacts is once again made wit the "load" contact set 138, the motor 108 is inactivated but the relays are not reset. Because of this, when a next batch of films 12 are developed, the wheel 136 will be first directed toward the contact set 144. However, within the current cycle of operation, upon the recontact of the wheel 136 with the "load" contact set 138, the agitation motor 64 is once again activated concurrently with the fan motor 24 for the required period of time set in the control and timer mechanism 148 and after the expiration of this time period the whole unit shuts down with the finish of the development process.

The relays 146 sense the position of the wheel 136 at the particular contact sets 138, 140, 142 and 144 and appropriately reverse the direction of rotation of the motor 108 when the wheel 136 contacts either the development contact set 140 or the "fixing" contact set 144. However, when the wheel 136 contacts either the "load" contact set 138 or the "rinse" contact set 142, the direction of the motor 108 is held constant.

Because the gear 78 (a track follower means) can be both rotated and moved concurrently moved across the gear rack 58 by the first motor 108 and further because the gear 78 can be rotated in a fixed position by motion communicated via the second motor 64 to the gear sector 56, the film carrier 90 can move in a first mode of motion wherein it is moved from one of the tanks to another of the tanks and it can be moved in a second mode of motion wherein it is agitated within an individual tank or within the air stream.

This use of the two motors to drive the gear 78 results in a simple yet efficient manner of utilizing a single wash tank and moving the film carrier through the appropriate development, wash and fix cycles. Also, the film can be developed, washed, fixed, washed and finally dried in a space only 3/5 as long compared to other transport type systems. Because of this, the device 10 is a smaller, more compact unit compared to prior devices.

I claim:

1. An apparatus for processing radiation sensitive film which comprises:

a housing;

a plurality of fluid containing tanks located on said housing in a linear array;

a gear sector located on said housing in operative association with said tanks;

a gear sector follower means located in operative association with said gear sector so as to move in a pathway on said gear sector;

a film carrier means for carrying film, said film carrier means operatively associated with said gear sector follower means so as to be moved by said gear sector follower means successively from one of said tanks to another of said tanks;

means for moving said gear sector follower means in said pathway on said gear sector;

means for moving said film carrier means in an epitrochoidal manner on said housing, said means operatively associating said film carrier means with said gear sector follower means,

2. The apparatus of claim 1 wherein:

said film carrier means includes a film holding means;

said film holding means moved in said epitrochoidal manner from one of said tanks to another of said tanks.

3. The apparatus of claim 2 wherein:

said gear sector follower means includes a circular member, said circular member rotating on said gear sector;

said film carrier means operatively connected to said circular member at a position off center from the center of rotation of said circular member on said gear sector.

4. The apparatus of claim 1 wherein:

said gear sector follower means includes a circular member, said circular member rotating on said gear sector;

said film carrier means operatively connected to said circular member at a position off center from the center of rotation of said circular member on said gear sector.

5. The apparatus of claim 1 including:

said means for moving said gear sector follower means further including a first motor means and a connecting means, said first motor means capable of being energized and de-energized, said connecting means connecting between said first motor means and said gear sector follower means, said gear sector follower means moved in said pathway on said gear sector by motion transferred to it by said connecting means from said first motor means.

6. An apparatus for processing radiation sensitive film which comprises:

a housing;

a plurality of fluid containing tanks located on said housing in association with one another;

an arcuate shaped track means located on said housing in operative association with said tanks;

a track follower means located in operative association with said track means so as to move in a pathway on said track means;

a film carrier means for carrying film, said film carrier means operatively associated with said track follower means so as to be moved by said track follower means successively from one of said tanks to another of said pathway on said track means;

said means for moving said track follower means further including a first motor means and a connecting means, said first motor means capable of being energized and de-energized, said connecting means connecting between said first motor means and said track follower means, said track follower means moved in said pathway on said track means by motion transferred to it by said connecting means from said first motor means;

a second motor means, said second motor means operatively connected to said track means, said second motor means capable of being energized and de-energized, said second motor means for moving said track means with respect to said housing.

7. The apparatus of claim 6 including:

control means operatively associated with both said first motor means and said second motor means, said control means for energizing and de-energizing said first and said second motor means.

8. The apparatus of claim 7 wherein:

in a first mode of operation said control means energizing said first motor means to move said track follower means on said track means and said film carrier means from one tank to another and in a second mode of operation said control means de-energizing said first motor means and energizing said second motor means to move said track means with respect to said housing, said connecting means holding said track follower means in a fixed location with respect to said housing, said track means moving with respect to said housing moving said track follower means about a fixed point with respect to said housing with said movement of said track follower means transferred to said film carrier means moving said film carrier means.

9. The apparatus of claim 8 wherein:

said film carrier means includes a film holding means;

said film holding means moved in an epitrochoidal manner from one of said tanks to another of said tanks in said first mode of operation;

said film holding means moved in an oscillatory manner in said second mode of operation.

10. The apparatus of claim 8 wherein:

said track follower means includes a circular member, said circular member rotating on said arcuate shaped track means;

said film carrier means operatively connected to said circular member at a position off center from the center of rotation of said circular member on said track means.

11. An apparatus for processing radiation sensitive film which comprises:

a housing;

a plurality of fluid containing tanks located on said housing in a linear array;

a first motor located on said housing;

an elongated gear rack located on said housing in association with said tanks and extending essentially parallel to said linear array of tanks;

a gear located on said gear rack;

a film carrier operatively connected to said gear so as to be moved by said gear;

a connecting means operatively associated between said first motor and said gear whereby said gear is moved linearly on said gear rack in response to motion imparted to said connecting means by said motor and in response thereto said gear moving said film carrier from one of said tanks to a further of said tanks.

12. The apparatus of claim 11 wherein:

said gear rack is arcuate in shape in elevational view and is straight in plan view with the gear teeth of said gear rack positioned essentially perpendicular to the straight dimension of said gear rack.

13. The apparatus of claim 11 wherein:

said gear moves on said gear rack by rotating on said gear rack;

said film carrier is operatively connected to said gear at a point off center from the center of rotation of said gear.

14. The apparatus of 14 including:

a second motor located on said housing, said second motor operatively connected to said gear rack so as to move said gear rack, said movement of said gear rack moving said gear and in response to said movement of said gear said film carrier moving on said housing.

15. The apparatus of claim 11 wherein:

said film carrier includes a film holding means, a holder means support means and means connecting said holder means support means to said gear;

said film holding means for holding individual pieces of film;

said holder means support means for receiving said film holding means and retaining said individual pieces of film in said holding means.

16. An apparatus for processing radiation sensitive film which comprises:

a housing;

a plurality of fluid containing tanks located on said housing in association with one another;

a first motor located on said housing;

a gear rack located on said housing in association with said tanks:

a gear located on said gear rack;

a film carrier operatively connected to said gear so as to be moved by said gear;

a connecting means operatively associated between said first motor and said gear whereby said gear is moved on said gear rack in response to motion imparted to said connecting means by said motor and in response thereto said gear moving said film carrier from one of said tanks to a further of said tanks;

a second motor located on said housing, said second motor operatively connected to said gear rack so as to move said gear rack, said movement of said gear rack moving said gear and in response to said movement of said gear said film carrier moving on said housing.

17. The apparatus of claim 16 wherein:

said gear rack is arcuate in shaped and is located on a gear sector;

further including a second connecting means, said second connecting means connecting between said second motor and said gear sector, said second connecting means oscillating said gear sector in response to motion imparted to said second connecting means from said second motor, oscillating of said gear sector rotating said gear first in one direction and then in the opposite direction to agitate said film carrier within one of said tanks.

18. The apparatus of claim 17 wherein:

movement of said gear on said gear sector by said first motor moves said film carrier in an epitrochoidal manner from one of said tanks to a further of said tanks.

19. The apparatus of 18 wherein:

said film carrier includes a film holding means, a holder means support means and means connecting said holder means support means to said gear;

said film holding means for holding individual pieces of film;

said holder means support means for receiving said film holding means and retaining said individual pieces of film in said holding means.

20. The apparatus of claim 16 further including: control means operatively associated with both said first motor and said second motor said control means for energizing and de-energizing said first and said second motor.

21. The apparatus of claim 20 wherein:

said control means includes at least one electrical contact and a moving contact, said moving contact operatively associated with said connecting means so as to be moved by said connecting means, said moving contact contacting said electrical contact.

* * * * *

UNITED STATES PATENT AND TRADEMARK OFFICE

CERTIFICATE OF CORRECTION

PATENT NO. : 4,579,437

DATED : April 1, 1986

INVENTOR(S) : Hal R. Linderfelt

It is certified that error appears in the above-identified patent and that said Letters Patent is hereby corrected as shown below:

Column 5, line 45, "10" should be --100--.

Column 6, line 14, after the numeral "114" insert the word --to--.

Column 7, line 21, "it" should be --its--.

Column 7, line 47, "108" should be --64--.

Column 8, line 51, "contacts", first occurrence, to -- contact--

Column 9, line 13, "contacts" should be --contact--.

Column 9, line 14, "wit" should be --with--.

Column 9, line 36, the first occurrence of the word "moved" should be deleted.

Column 11, line 64, the second occurrence of the numeral "14" should be --13--.

Column 12, line 34, "shaped" should be --shape--.

Signed and Sealed this

Twenty-eighth Day of October, 1986

[SEAL]

*Attest:*

DONALD J. QUIGG

*Attesting Officer* *Commissioner of Patents and Trademarks*